United States Patent [19]

Terai et al.

[11] Patent Number: 4,900,248

[45] Date of Patent: Feb. 13, 1990

[54] SKID RAIL

[75] Inventors: Kazuto Terai, Ohmiya; Susumu Isobe, Nagoya; Kenji Tsukuda, Chita; Hisao Inoue, Nagoya; Hiroshi Kobayashi, Nishio, all of Japan

[73] Assignees: Daido Tokushuko Kabushiki Kaisha, Aichi, Japan; Inco Alloys International, Inc., Hunnington, W. Va.

[21] Appl. No.: 300,985

[22] Filed: Jan. 24, 1989

[30] Foreign Application Priority Data

Jan. 26, 1988 [JP] Japan ..... 63-15345

[51] Int. Cl.[4] ..... F27D 3/02

[52] U.S. Cl. ..... 432/234; 432/235; 432/236

[58] Field of Search ..... 432/233, 234, 236, 238, 432/258, 235

[56] References Cited

U.S. PATENT DOCUMENTS

| | | | |
|---|---|---|---|
| 4,056,351 | 11/1977 | Knaak | 432/235 |
| 4,093,760 | 6/1978 | O'Malley | 432/234 |
| 4,368,038 | 1/1983 | Bourdon et al. | 432/258 |
| 4,601,659 | 7/1986 | Webster et al. | 432/234 |
| 4,604,056 | 8/1986 | Jones | 432/234 |
| 4,747,775 | 5/1988 | Takagi et al. | 432/234 |

*Primary Examiner*—Henry C. Yuen

*Attorney, Agent, or Firm*—Varndell Legal Group

[57] ABSTRACT

Disclosed is an improved skid rail used in furnaces, particularly, the furnaces for heating steel pieces for hot processing. The skid rail uses, as the material of the skid members thereof, an oxide-dispersion reinforced type super alloy which comprises certain amounts of Cr, Fe, Al and Ti, and optionally a certain amount of Co, the balance being Ni, and contains fine particles of a high melting point metal oxide such a $Y_2O_3$, $ZrO_2$ and $Al_2O_3$ dispersed in the austenitic matrix of the alloy.

4 Claims, 3 Drawing Sheets

SKID RAIL

BACKGROUND OF THE INVENTION

1. Field of the Invention

The present invention concerns improvement in the skid rail of furnaces used in, for example, steel industry for heating steel pieces.

2. State of the Art

As the material for preparing skid rails of heating furnaces such as walking beam furnaces or pusher furnaces, heat-resistant casting alloys have been used. In the soaking zone of a furnace, the skid rails are subjected to such a high temperature as 1200°-1350° C., and suffer from heavy strain and abresion, and therefore, the libes of the skid rails are short.

It has been proposed to use ceramics having high heat-resistant and anti-abrasion properties as the material of the skid rails or skid buttons (for example, Japanese Utility Model Publication No. 35326/1980), and the assignee has made efforts in improving the material (for example, Japanese Patent Disclosure No. 89516/1985).

So-called fine ceramics materials such as SiC and $Si_3N_4$ preferable from the view point of high shock-resistance thereof, which is one of the properties requested to the skid rails, are easily damaged by oxidation when used in a strongly oxidative atmosphere. On the other hand, research has been made since few years ago on the super alloys of oxide-dispersion reinforced type, i.e., Ni-based super alloys in which fine particles of an oxide having a high melting point such as $Y_2O_3$ are dispersed, and application thereof to gas-turbines and jet-engines has been tried (for example, Japanese Patent Publication No. 38665/1981). As to high temperature furnace it has been proposed to use an oxide-dispersion reinforced type super alloy of the composition consisting of 12.5-20% Cr, up to 1% Al, up to 0.1% C and up to 0.5% (volume) $Y_2O_3$, the balance being Ni, as the material for mesh belts (Japanese Patent Publication No. 9610/1984).

SUMMARY OF THE INVENTION

The object of the present invention is to provide skid rails for heating furnaces having not only high temperature deformation resistance, anti-abrasion property and shock resistance, but also a good oxidation resistance by using the technology of reinforcing the heat-resistant super alloys with dispersed fine oxide particles.

BRIEF EXPLANATION OF DRAWINGS

FIG. 1 being a plan view; FIG. 2, a side elevation view; and FIG. 3, a cross-sectional view.

FIG. 4 being a plan view corresponding to FIG. 1; and FIG. 5, a side elevation view corresponding to FIG. 2.

DETAILED EXPLANATION OF PREFERRED EMBODIMENTS

Figure 1:
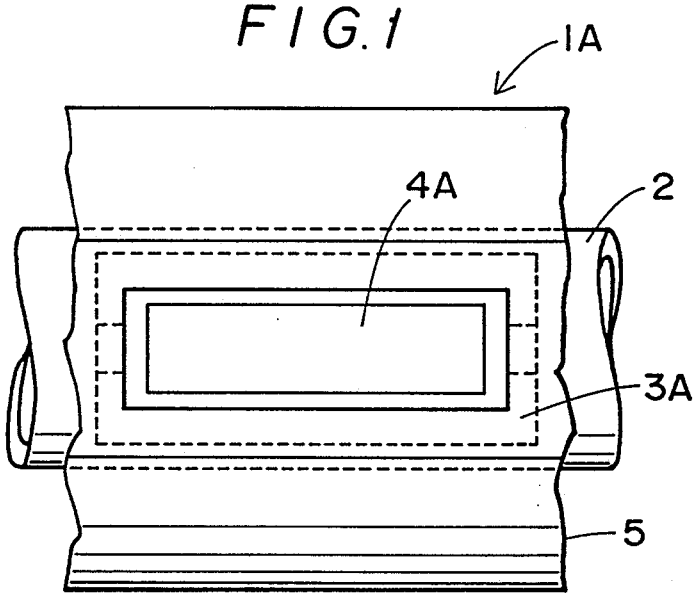
FIG. 1 to FIG. 3 illustrate a typical embodiment of the skid rail according to the invention.
Figure 2:
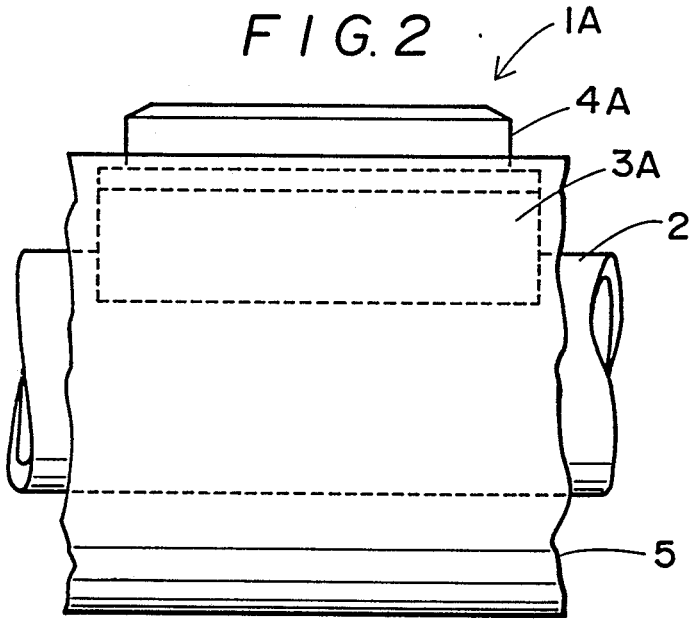
Figure 3:
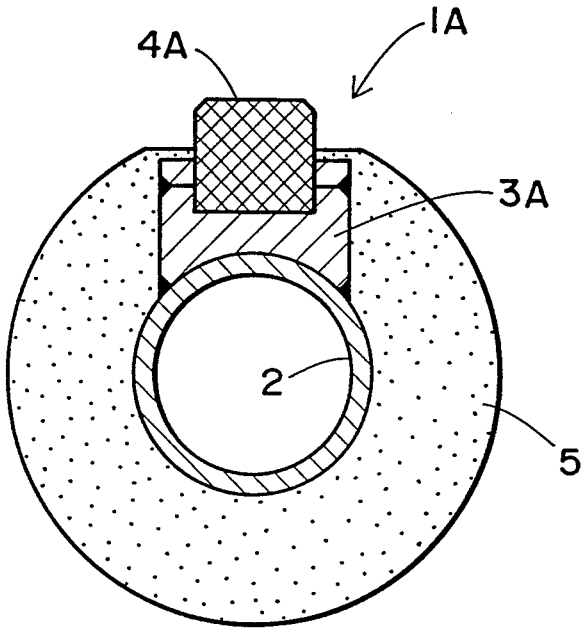

A typical embodiment of the skid rail according to the invention is, as shown in FIG. 1 to FIG. 3, a skid rail 1A made by welding metal saddles 3A on a water-cooled skid pipe 2, attaching a skid members 4A to the saddles and covering all the members except for the skid members with refractory insulator 5, which is characterized in that, as the material of the skid member, an oxide-dispersion reinforced type super alloy comprising 18-40% of Cr, each up to 5% of Fe, Al and Ti and the balance of Ni, and containing 0.1-2% of fine particles of a high melting point metal oxide or oxide dispersed in the austenite matrix. Preferable range of Cr-content is 20-40%, and more preferable range is 25-35%. The high melting point metal oxide may be one or more selected from $Y_2O_3$, $ZrO_2$ and $Al_2O_3$.

The super alloy may further contain up to 5% of CO.

Figure 4:
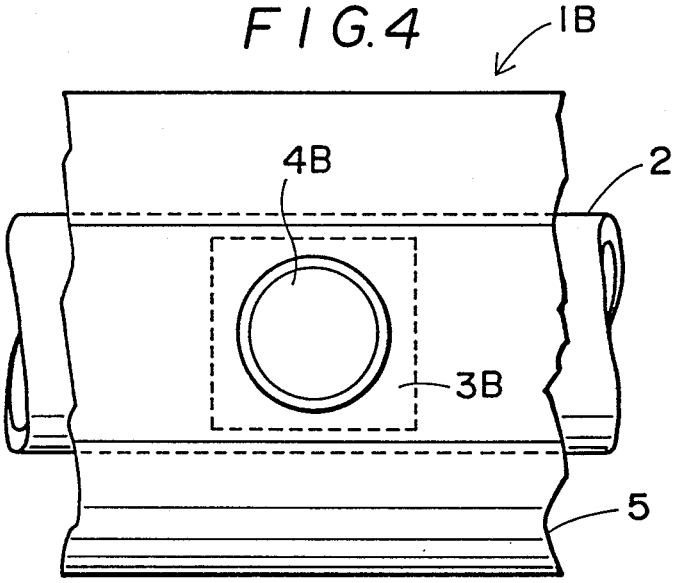
FIG. 4 and FIG. 5 illustrate another embodiment of the skid rail according to the invention.
Figure 5:
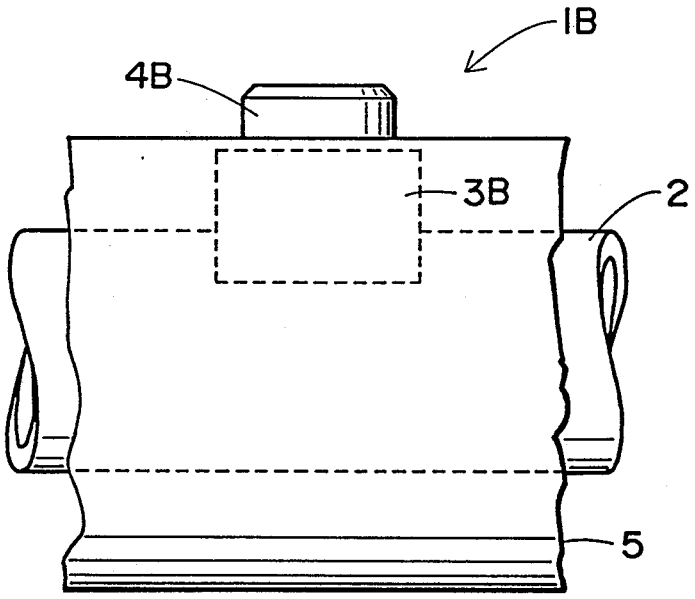

Another embodiment of the skid rail according to the invention is the skid rail 1B shown in FIG. 4 and FIG. 5, which uses cylindrical saddles 3B, to which button shaped skid members 4B are attached.

In order to produce the above mentioned oxide dispersion reinforced type super alloy, so-called mechanical alloying technology developed by INCO (The International Nickel Co., Inc.) is useful. The technology comprises finely grinding and mixing powders of metal components and fine crystals of a high melting point metal oxide in a high kinetic energy type ball mill so as to produce an intimate and uniform mixture of very fine particles of the components. The mixture prepared by the mechanical alloying is then compacted and sintered by hot extrusion or hot interstatic pressing and, if necessary, machined to the skid member.

In general, oxide-dispersion reinforced type super alloys are stable even at a high temperature, and the above mentioned known alloys have alloy compositions suitable for the use such as turbin blades (Japanese Patent Publication No. 56-38665) or mesh belts (Japanese Patent Publication No. 59-9610) and contain suitable amounts of oxide particles. However, the known alloys are not useful as the material for the skid rail. By using the above described oxide-dispersion reinforced type super alloy according to the present invention, it is possible to achieve a high compression creep strength, as shown in the working examples described later, in addition to the heat-resistance and oxidation-resistance which meet using conditions in heating furnaces, and thus, durable skid rails are provided.

The reasons for selecting the compositions of the present super alloy are as follows:

Cr: 18-40%

If the content of Cr is less than the lower limit, the desired heat-resistance is not obtained. On the other hand, if it exceeds the upper limit, it becomes difficult to maintain the austenite structure. Preferable range of Cr content is 20-40%, particularly, 25-35%.

Fe: up to 5%

Content of Fe should be limited preferably to 1% or less. However, the super alloy of a higher Fe content up to 5% can be used as the material for the present skid rail. Therefore, return scrap may be used as the raw material of the super alloy.

Al: up to 5%, Ti: up to 5%

For usual skid rails contents of these components in the super alloy may be 1% or less. If, however, it is desired to enhance the anti-oxidation property, for example, for the skid rail to be used in heating furnaces with atmosphere of relatively large $O_2$ quantity (up to several %), further addition of those components up to 5% will give improved results. Addition of higher amounts will cause increase of harmful large inclusions.

Co: up to 5%

Addition of Co in an amount up to 5% is useful for increasing hot strength of the alloy. The effect will saturate at around 5%.

High melting point metal oxide: 0.1–2%

The most preferable metal oxide is $Y_2O_3$. For the skid rail used in heating furnaces of relatively low temperature (up to about 1200° C.) whole or a portion of $Y_2O_3$ may be replaced with $ZrO_2$ or $Al_2O_3$. Of course, combined use of two or three of $Y_2O_3$, $ZrO_2$ and $Al_2O_3$ is possible. Contents of the high melting point metal oxide should be 0.1% or more. Otherwise, the effect of stabilizing the super alloy at a high temperature will not be satisfactory. As the content increases, the effect slowdowns at about 1% and saturates at 2%, and therefore, a suitable content in this range should be chosen.

EXAMPLE

Oxide-dispersion reinforced type super alloys of INCONEL ALLOY MA758 group and having the composition as shown in Table 1 (weight %, the balance being Ni) were prepared by the above noted mechanical alloying process, and the alloys were hot extruded and machined to give testing materials.

The above obtained materials and a convertional skid rail material "TH101" (0.1C-32Cr-21Ni-23Co-2.5W-Zr) were subjected to compression test at a very high temperature for determining the durability as the material for the skid rail. Deformation (%) of the materials at various testing conditions are as shown in Table 2.

TABLE 1

| No. | C | Fe | Cr | Al | Ti | Co | Metal Oxide | |
|---|---|---|---|---|---|---|---|---|
| 1 | 0.05 | 1.0 | 30 | 0.3 | 0.5 | — | $Y_2O_3$ | 0.6 |
| 2 | 0.05 | 2.1 | 19 | 1.0 | 3.0 | 4.1 | $Y_2O_3$ | 0.8 |
| 3 | 0.05 | 1.9 | 25 | 0.5 | 1.7 | 2.4 | $Y_2O_3$ | 0.7 |
| | | | | | | | $ZrO_2$ | 0.2 |
| 4 | 0.05 | 0.9 | 33 | 0.5 | 0.4 | — | $Y_2O_3$ | 0.8 |
| | | | | | | | $Al_2O_3$ | 0.3 |

TABLE 2

| Alloy | Testing Conditions | Period (Hrs) 10 | 20 | 30 | 40 | 60 | 80 |
|---|---|---|---|---|---|---|---|
| TH101 | 1200° C. | | 3.62 | | 4.94 | 9.95 | 13.2 |
| No. 1 | 0.9 kg/mm$^2$ | | 0.06 | | 0.13 | 0.20 | 0.26 |
| TH101 | 1250° C. | | 4.72 | | 7.21 | 9.83 | |
| No. 1 | 0.6 kg/mm$^2$ | | 0.11 | | 0.23 | 0.34 | |
| TH101 | 1300° C. | 2.31 | 4.43 | 6.14 | | | |
| No. 1 | 0.4 kg/cm$^2$ | 0.09 | 0.19 | 0.28 | | | |
| No. 2 | | 0.08 | 0.16 | 0.23 | | | |
| No. 3 | | 0.07 | 0.15 | 0.22 | | | |
| No. 4 | | 0.09 | 0.18 | 0.26 | | | |

From reference to the case of alloy No. 1, 1300° C., stress 0.4 kg/mm$^2$ and 30 hours, it is seen that deformation of the conventional material reached 6.14% and, in contrast, that the deformation of the material according to the present invention was so small as 0.28%, thus the good results were ascertained.

In practical use in soaking zones of steel heating furnaces, life of the skid rail according to the present invention was more than 10 times of that of the conventional products.

In the case of alloys No. 3 and No. 4 where a portion of $Y_2O_3$ was replaced with $ZrO_2$ or $Al_2O_3$, when compared with the case of $Y_2O_3$ single use, extent of deformation is smaller even at longer testing periods, and the performance is much higher than that of the conventional material. Further, it is expected that, even if whole the $Y_2O_3$ is replaced with $ZrO_2$, $Al_2O_3$ or combination thereof, the resulting oxide-dispersion reinforced super alloy can be used at a relatively low heating furnace temperature around 1200° C.

The skid rail according to the present invention will exhibit, when used in various furnaces such as heating furnaces for hot processing of steel, excellent properties of anti-hot deformation, anti-oxidation, anti-abresion and thermal shock resistance, and therefore, it can be used for a long period. This will decrease maintenance labor of the heating furnaces and facilitates continuous operation thereof, thus decreased costs for energy and maintenance result in the costdown of hot processing of steel.

We claim:

1. A skid rail comprising metal saddles welded on a water-cooled skid pipe, skid members attached to the saddles and refractory insulator covering all the members except for the skid members; the material of the skid members being an oxide-dispersion reinforced type super alloy which consists essentially of 18–40% (by weight) Cr, up to 5% Fe, up to 5% Al, up to 5% Co and up to 5% Ti, and the balance of Ni, and contains fine particles of 0.1–2% high melting point metal oxide dispersed in the austenite matrix.

2. A skid rail of claim 1, wherein the high melting point metal oxide is $Y_2O_3$.

3. A skid rail comprising metal saddles welded on a water-cooled skid pipe, skid members attached to the saddles and refractory insulator covering all the members except for the skid members; the material of the skid members being an oxide-dispersion reinforced type super alloy which consists essentially of 20–40% Cr, up to 1% Fe, up to 1% Al and up to 1% Ti, and the balance of Ni, and contains fine particles of 0.1–2% high melting point metal oxide dispersed in the austenite matrix.

4. A skid rail of claim 3, wherein the high melting point metal oxide is $Y_2O_3$.

* * * * *